United States Patent [19]

Pringle

[11] Patent Number: 4,862,965

[45] Date of Patent: Sep. 5, 1989

[54] THREADLESS WELL TOOL AND METHOD OF MAKING

[75] Inventor: Ronald E. Pringle, Houston, Tex.

[73] Assignee: Camco, Incorporated, Houston, Tex.

[21] Appl. No.: 202,350

[22] Filed: Jun. 6, 1988

[51] Int. Cl.[4] ..... E21B 43/12

[52] U.S. Cl. ..... 166/380; 166/242; 285/404

[58] Field of Search ..... 166/380, 242; 285/403, 285/404

[56] References Cited

U.S. PATENT DOCUMENTS

| | | | |
|---|---|---|---|
| 3,781,040 | 12/1973 | Lasko et al. | 285/404 X |
| 3,888,519 | 6/1975 | Smith et al. | 285/404 X |
| 3,939,913 | 2/1976 | Motz | 166/375 |
| 4,538,838 | 9/1985 | Pringle | 285/92 X |
| 4,767,137 | 8/1988 | Zinner et al. | 285/404 X |

*Primary Examiner*—William P. Neuder

*Attorney, Agent, or Firm*—Fulbright & Jaworski

[57] ABSTRACT

A well tool having a body with a plurality of sections which are joined together without welds or threads. The sections form telescoping interconnections with adjacent sections and each interconnection includes a male and female part with an outer end. The parts are telescopically joined and rotationally aligned and sealing means are positioned between each male and female part. A hole is drilled through the female part and into the male part between the ends and a removable plug is positioned in the hole for providing for the transfer of rotational and longitudinal forces. Aligned eccentrically positioned fluid passageways extend through each of the sections.

6 Claims, 6 Drawing Sheets

THREADLESS WELL TOOL AND METHOD OF MAKING

BACKGROUND OF THE INVENTION

Various types of oil and/or gas well tools are used in which the body includes a plurality of metal sections threadably connected together to enclose the working parts of the tool. The threaded connections must be pressure tight and generally include sealing means. However, in assembling the well tool, various adjustments have to be made in the internal workings of the tool. This requires that the threaded connections of the well tool be repeatably unscrewed and rescrewed together until the working parts are suitably adjusted. This leads to the possibility of damaging or galling the threaded connections. Furthermore, since the threaded connections must be made up tight to be pressure tight, this requires that adjacent parts must have concentric mating parts in view of the fact that the rotational position of the various sections relative to each other may vary.

However, it is also desired to run fluid control lines downhole to operate various well equipment. In some cases there is insufficient room in the well to allow the control line to fit on the outside of a well tool for controlling equipment therebelow. Therefore, it would be desirable to run the control line through the body of the uphole well tools. However, this would be difficult to do in well tools having a plurality of sections threaded connected together.

The present invention is directed to a method and apparatus for making up and sealing sections of a well tool without the use of welds or threads and may be connected and disconnected a multiple of times and still provide a pressure tight connection. The present invention also provides a longitudinally extending passageway, through each of the sections of a well tool, which is aligned for recovering a continuous flow line therein.

SUMMARY

The present invention is directed to a well tool which has a body including a plurality of sections which are joined together without welds or threads. The sections form a telescoping interconnection with adjacent sections. Each interconnection includes a male and a female part, each of which includes an outer end. Sealing means are positioned between each male and female part and a hole is drilled through the female part and into the male part between the ends. A removable plug is positioned in the hole for providing for the transfer of rotational and longitudinal forces in either direction through the interconnections.

Still a further object of the present invention is wherein one of the sections has telescoping interconnections at each end.

Still another object of the present invention is the provision of a longitudinally extending eccentrically positioned passageway through each of the sections in which the passageways are aligned for receiving a continuous flow line therein.

A further object of the present invention is the provision of a method of making a well tool having a body consisting of a plurality of sections by interconnections without using welds or threads to join the sections together. The interconnections include a male and a female part, each of which includes an outer end and the method includes telescopically joining adjacent parts together with sealing means between each joined part, rotationally aligning the parts, and drilling a hole through the telescopically joined parts through the female part and into the male part between the end and placing a removable plug into the hole for providing for the transfer of rotational and longitudinal forces in either direction through the interconnections.

Yet a further object of the method is wherein the sealing means are metal seal faces and the method includes longitudinally pressing the sections together for energizing the seal means before drilling the holes.

The method further includes aligning longitudinally extending eccentrically positioned passageways in each of the sections for receiving a continuous flow line therein.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

While the present invention will be described, for purposes of illustration only, as incorporated in a well safety valve, it will be understood that the present invention may be used with ohter well tools such as mandrels, packers, sliding sleeves, and other types of downhole well tools.

Figure 1A:
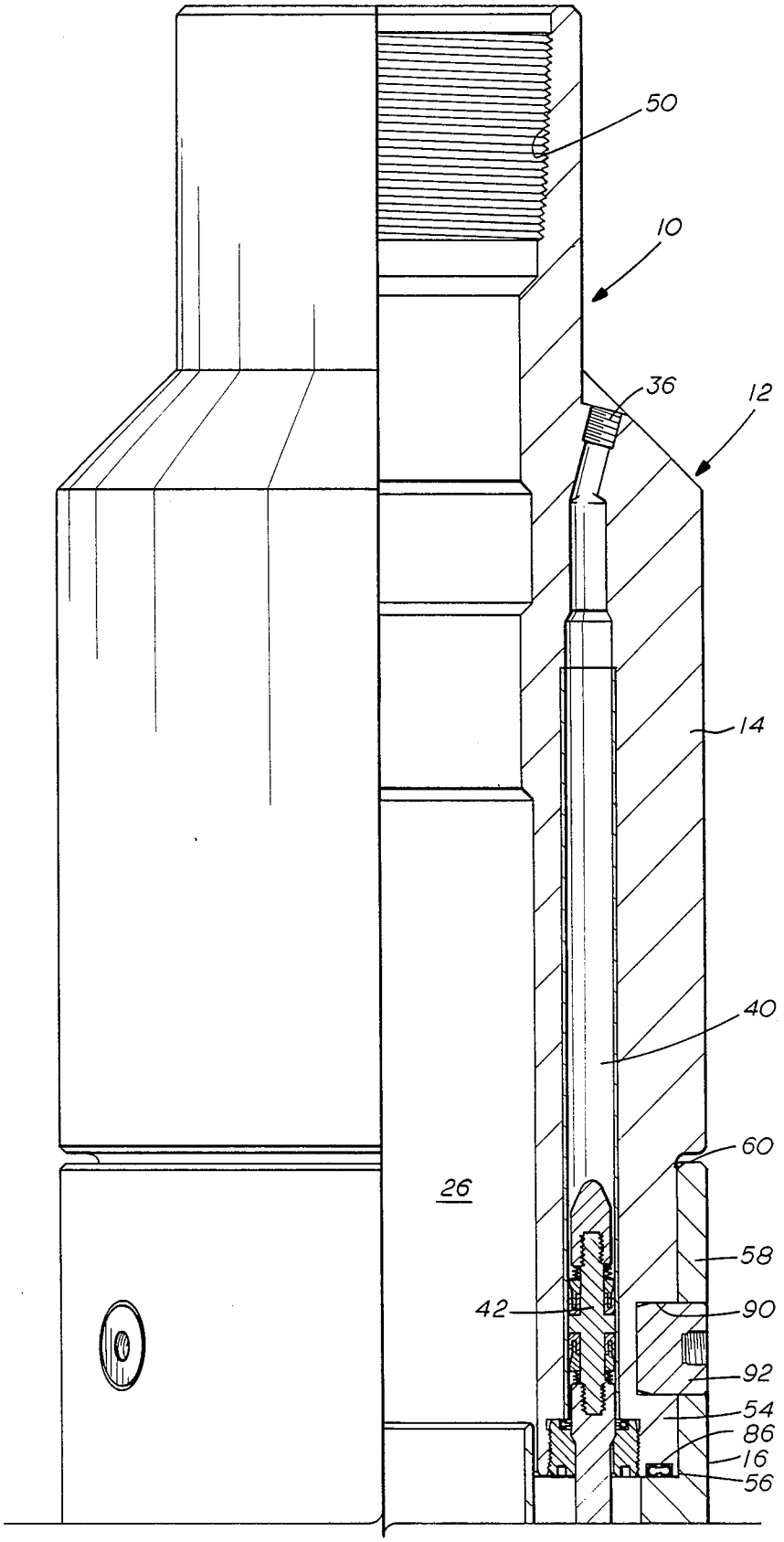
FIGS. 1A, 1B, and 1C are continuous of each other and are an elevational view, in quarter section, of one embodiment of the present invention.
Figure 1B:
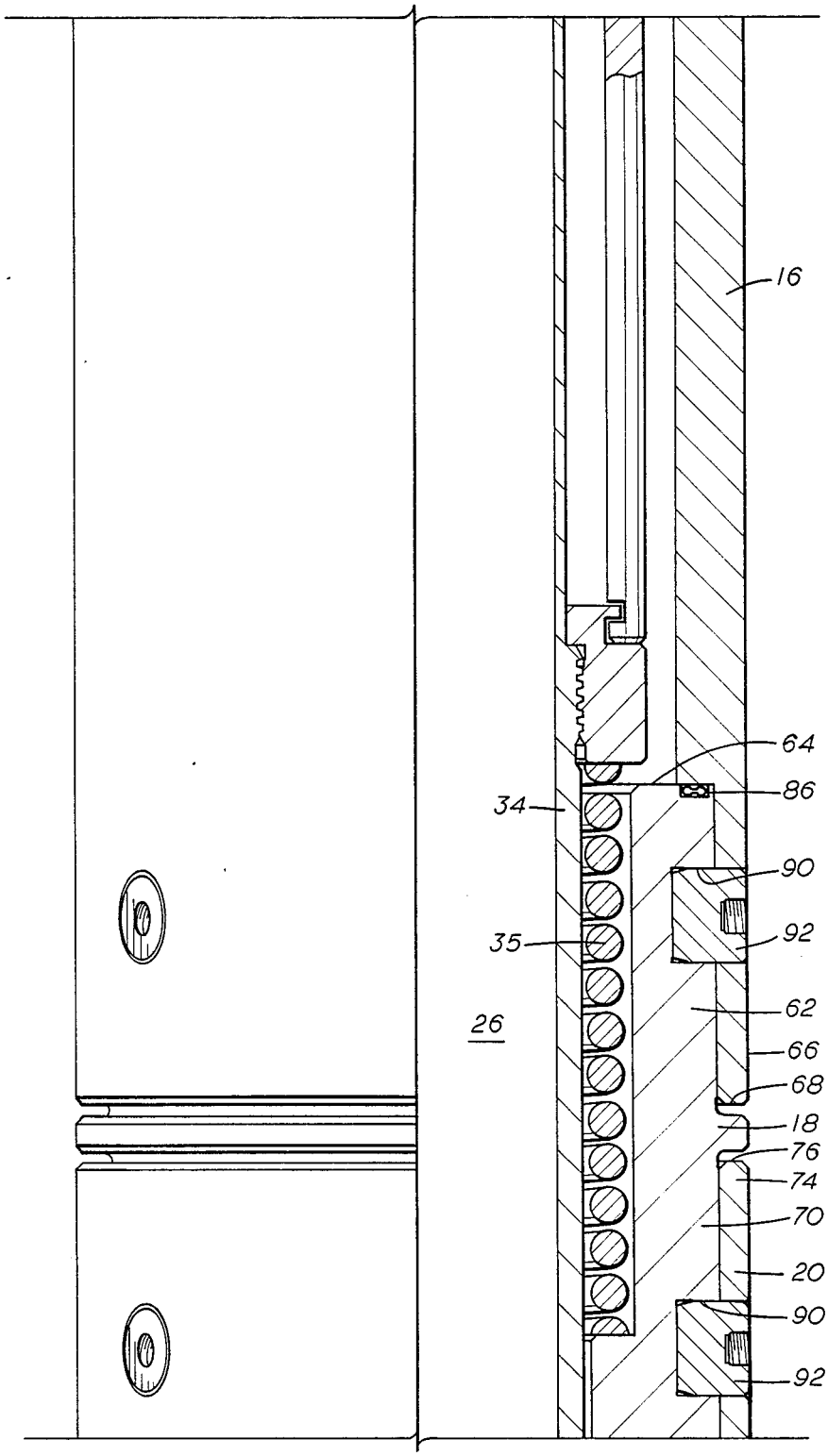
Figure 1C:
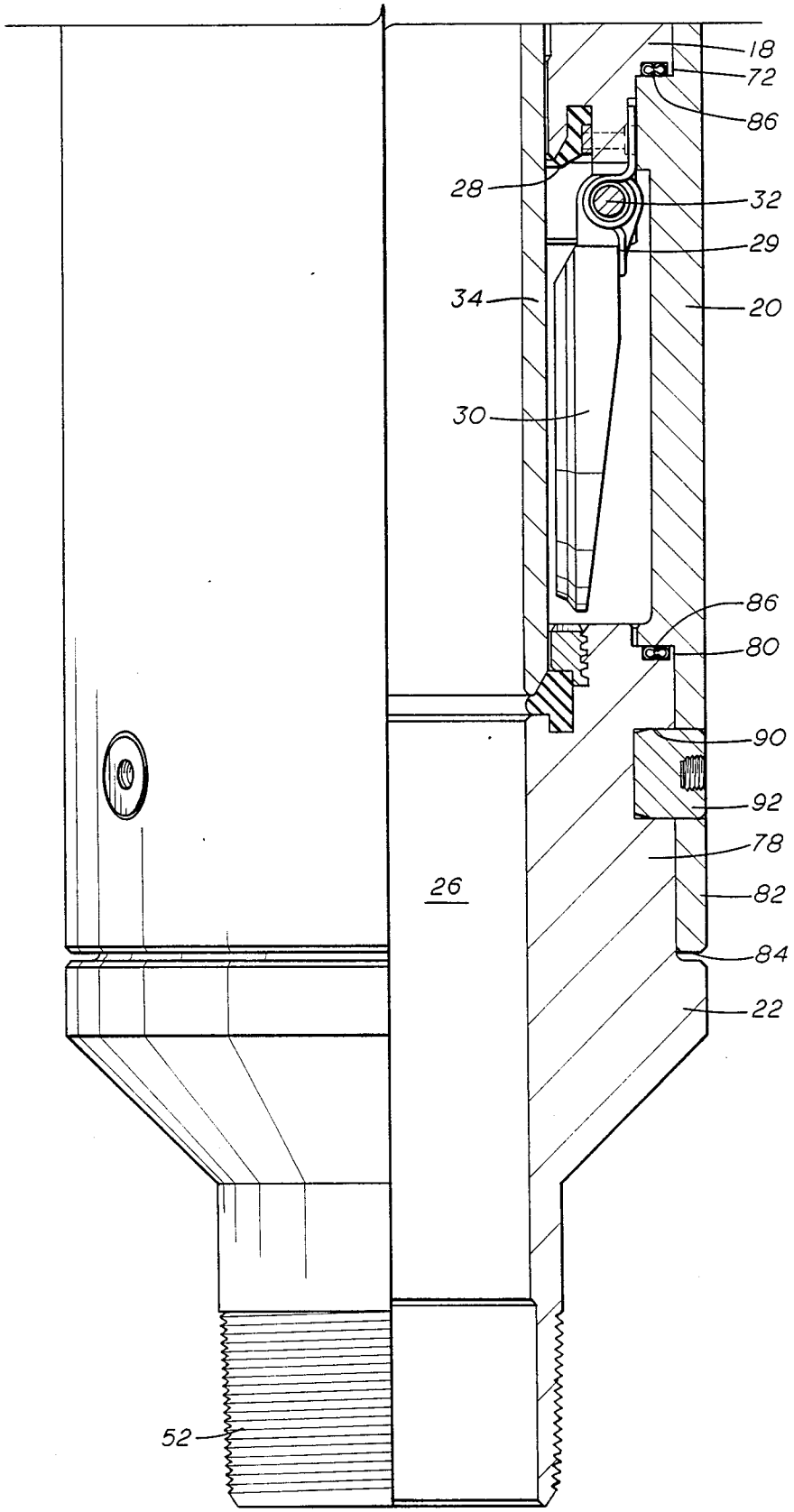

Referring now to the drawings, and particularly to FIGS. 1A, 1B and 1C, the reference numeral 10 generally indicates a piston actuated well safety valve having a body or housing 12 which includes a plurality of sections 14, 16, 18, 20 and 22.

The valve 10 includes a bore 26, an annular valve seat 28 (FIG. 1C) positioned about the bore 26, and a valve closure element 30 connected to the body 10 by a pivot pin 32. A flow tube 34 is telescopically movable in the body 12 and through the valve seat 28. When the flow tube 34 is moved to a downward position, as best seen in FIG. 1C, the tube 34 pushes the valve element 30 away from the seat 28 and opens the valve. When the flow tube 34 is moved upwardly, the valve element 30 seats on the seat 28 by the action of spring 29 and closes the well bore 26. The flow tube 34 is biased upwardly by various forces including spring 35 (FIG. 1B) and the valve is closed by the removal of hydraulic fluid through a control port 36 (FIG. 1) connected to the well surface which supplies fluid to a cylinder 40 and against one or more pistons 42 movable in the cylinder 40. The pistons 42 in turn act against the flow tube 34. When sufficient hydraulic fluid pressure is applied to the cylinder 40, the flow tube 34 is moved downwardly to open the valve 10. If the fluid pressure in the chamber 40 is reduced sufficiently, the flow tube 34 will be moved upwardly beyond the seat 28 to allow the valve element 30 to close on the seat 28. The above described safety valve is conventional.

The safety valve 10 includes a threaded connection 50 at the top and a threaded connection 52 at the bottom for connecting the safety valve 10 into a tubing string. However, in a normal safety valve, the various sections 14,16, 18, 20 and 22 are joined together by threaded connections and seals. Conventional threads and seals are normally satisfactory in making up threaded connections which are not required to be threaded and unthreaded a number of times. However, such threaded connections require a high torque in order to satisfactorily seal any accompanying metal seals. And repeated threading and unthreading of the threaded connections has a tendency to gall, particularly the various corrosion resistant alloy metals being used in well bores today. When the threaded connections become galled, they are defective and must be replaced which is expensive and time-consuming. In assembling the various internal parts of the valve 10, the various parts must frequently be exposed and adjusted before the working parts are finally adjusted. This requires that the various sections of the tool be threaded and unthreaded which increases the possibility of galling.

The present invention is directed to a method and apparatus for making up a well tool having a plurality of sections which are joined together without welds or threads and with a seal which will hold the desired pressure and in which the connections may be made up and broken out a multiple of times without damaging the parts.

In the present invention each of the sections forms a telescoping interconnection with adjacent sections and each interconnection includes a male and female part, each of which includes an outer end. Thus, adjacent sections 14 and 16 form a telescoping interconnection in which the section 14 includes a male part 54 having an outer end 56 and the section 16 includes a female part 58 having an outer end 60. The interconnection between the sections 16 and 18 includes the male part 62 having an outer end 64 and a female part 66 having an outer end 68. The interconnection between the sections 20 and 18 includes a male part 70 having an outer end 72 and a female part 74 having an outer end 76. Similarly, the interconnection between sections 20 and 22 includes a male part 78 having an outer end 80 and a female part 82 having an outer end 84.

Sealing means are positioned between each male and female part. In the embodiment of FIGS. 1A, 1B and 1C, the seals 86 are shown as metal face seals.

In assembling the safety valve 10, the adjacent male and female parts are telescopically joined together with the sealing means between each joined part after the internal parts of the valve 10 have been assembled. At the same time, the sections 14, 16, 18, 20 and 22 are rotationally aligned. After the valve 10 is correctly assembled, a hole 90 is drilled through the telescopically joined parts through the female part and into the male part between the ends. That is, the hole 90 is drilled through the female part 80 and into the male part 54 between the ends 56 and 60. Similarly, other holes 90 are drilled between each interconnecting male and female part between their respective ends. Thereafter, a removable plug 92 is positioned in the holes 90 with a force fit. It is to be noted that the plugs 92 provide for the transfer of rotational and longitudinal forces in either direction through the interconnections between the sections. In order to energize the metal face seals 86 between adjacent male and female parts, the sections 14, 16, 18 and 22 must be longitudinally pressed together with a sufficient force for energizing the seals 86 into a sealing relationship before drilling the holes 90. For example, the upper and lower ends of the tool 10 are longitudinally pressed together with a high force, for example 100,000 pounds.

After the tool 10 is assembled, and pressure tested, it can be easily disassembled by removing one or more of the plugs 20 for further adjusting of the internal parts or replacement of the seals 86 if required and again reassembled and reconnected.

Figure 2A:
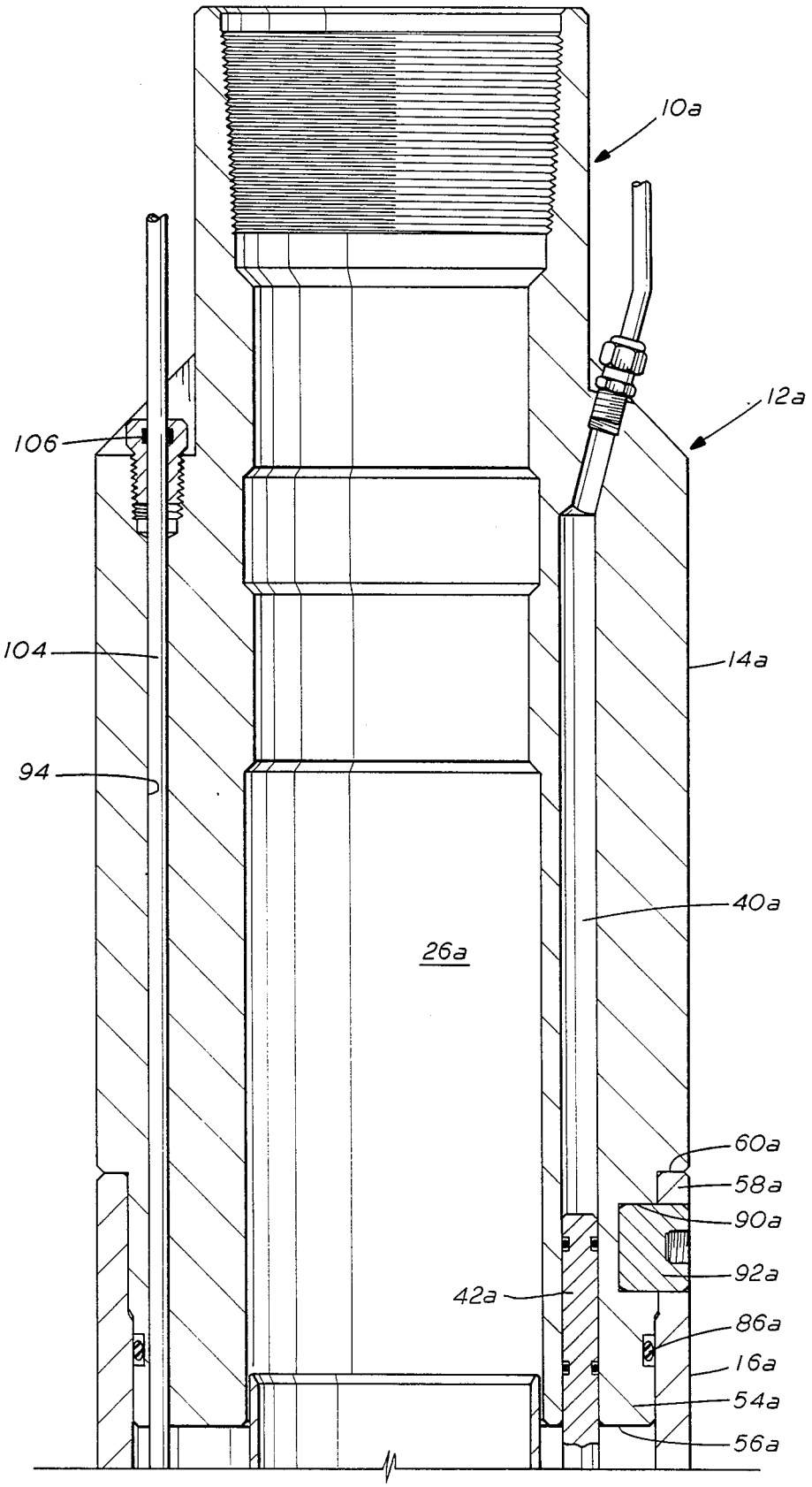
FIGS. 2A, 2B, and 2C are continuations of each other and are an elevational view, in cross section, of another embodiment of the present invention.
Figure 2B:
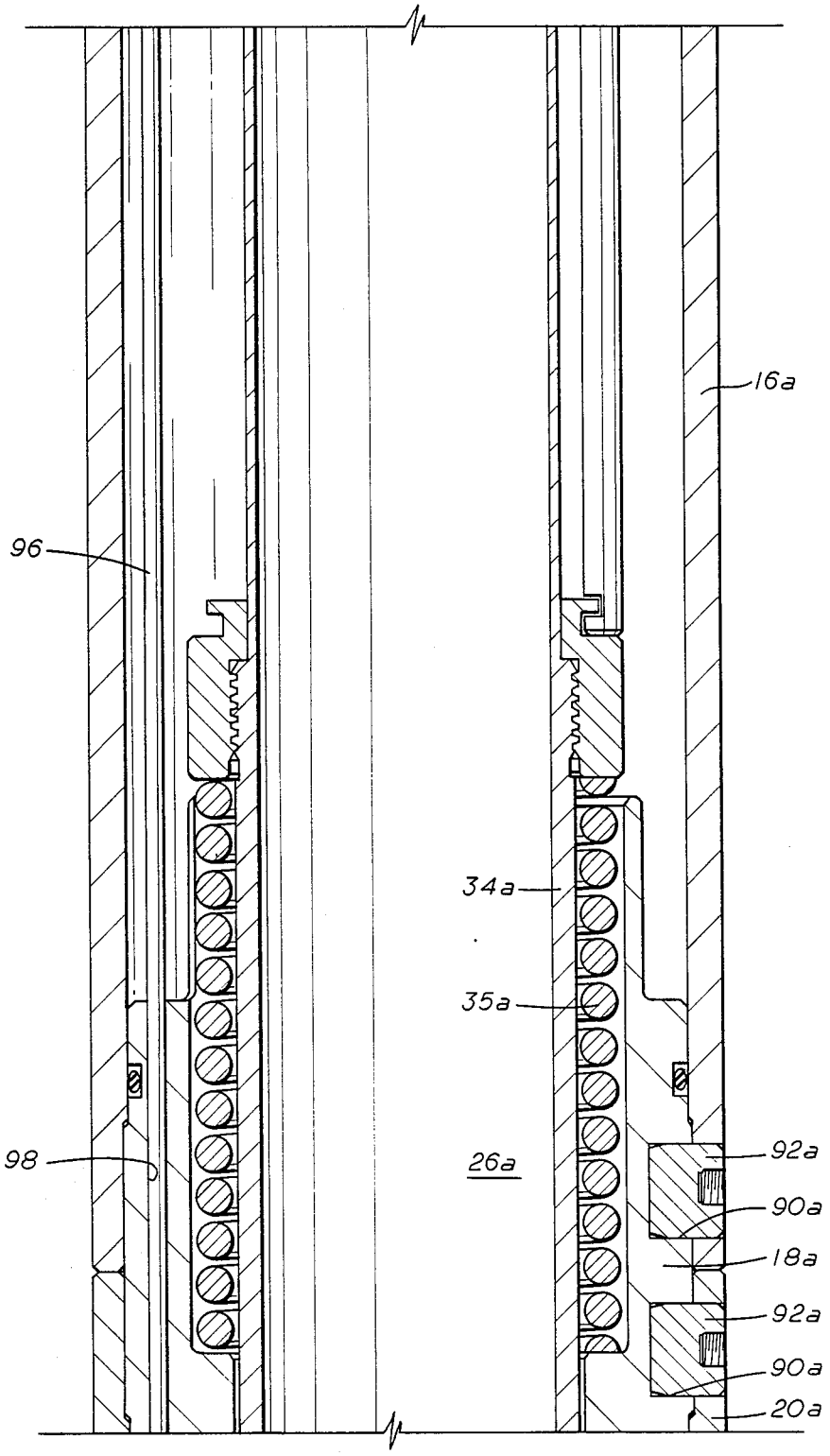
Figure 2C:
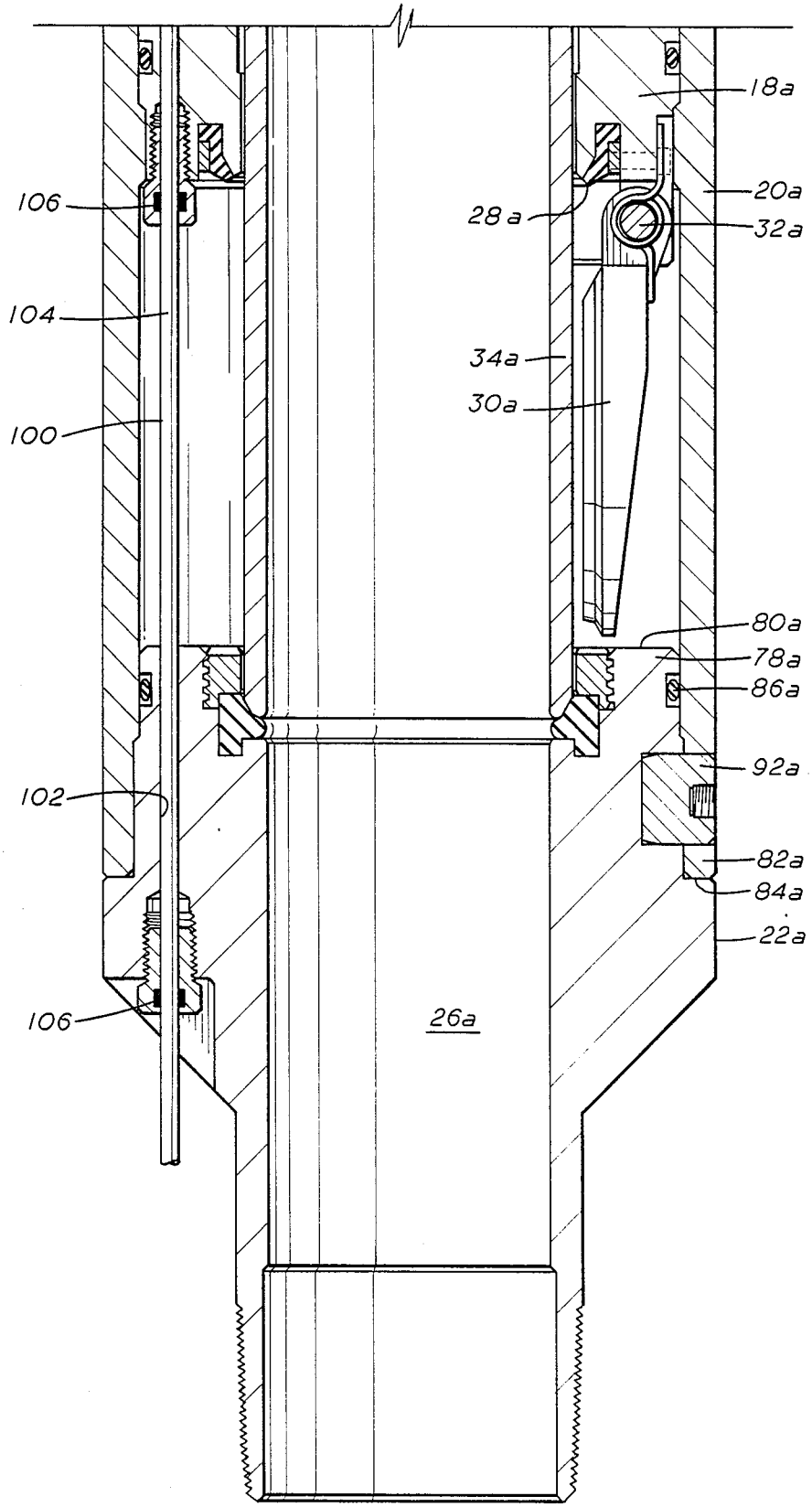

Referring to FIGS. 2A, 2B and 2C, another embodiment is shown wherein like parts to those in FIGS. 1A, 1B and 1C are similarly numbered with the addition of the suffix "a." In this embodiment, the seals **86*a*, instead of being metallic seals, may be elastomeric seals which may be satisfactory in some environments. In this embodiment, the sections 14*a*, 16*a*, 18*a*, 20*a* and 22*a*, may be telescopically joined and rotationally positioned without requiring a high longitudinal force to be placed on the assembled sections for energizing the seals 86*a***.

Another feature shown in this embodiment, which can also be incorporated within the embodiment of FIGS. 1A, 1B and 1C, is the provision of a passageway extending through the body **12*a* for the receipt of a fluid line. A fluid passageway through the tool 10*a* may be desirable for many reasons. For example, the fluid passageway could be used to control additional well tools downhole from the tool 10*a* or the fluid passageway could be used for injecting well fluids downhole. In some cases there is insufficient room between the tool 10*a* and the casing (not shown) to allow positioning a fluid passageway outside of the tool 10*a***. However, it is difficult to provide for a fluid passageway eccentrically positioned in a well tool having a plurality of threaded connections.

In the tool **10*a* each of the sections is provided with a longitudinally extending eccentrically positioned passageway through each of the sections. Thus, section 14*a* includes a passageway 94, section 16*a* includes a passageway 96, section 18*a* includes a passageway 98, section 20*a* includes a passageway 100, and section 22*a* includes a passageway 102. A continuous fluid line 104 may be inserted through the passageways 94, 96, 98, 100 amd 102 without being broken or requiring connections internally of the tool 10*a*. The passageways 94, 96, 98, 100 and 102 are aligned to form a single passageway to receive the fluid line 104. Suitable seal means 106 are provided around the fluid line 104 at the top and bottom of the tool 10*a* and adjacent the valve closure member 30*a* for preventing well fluid from bypassing the tool 10*a*. Of course, the line 104 may be omitted if the passageways 94, 96, 98, 100 and 102** are provided with seals between adjacent passageways.

The method of making the well tool **10*a*** is apparent from the foregoing description of the tool but is generally directed to having a body consisting of a plurality of sections joined by interconnections without using welds or threads to join the sections together. The method includes using interconnection having a male and female part, each of which includes an outer end and telescopically joining the adjacent parts together with sealing means between each joined part and rotationally aligning the parts. Thereafter, the method includes drilling a hole through the telescopically joined parts through the female part and into the male part between the ends and placing a removable plug into the hole for providing for the transfer of rotational and longitudinal forces in either direction through the interconnection. The method further includes, in the embodiment in which the sealing means are metal faced seals, of longitudinally pressing the sections together for energizing the seal means before drilling the holes. The method further includes providing each section with a longitudinally extending eccentrically positioned passageway therethrough and aligning the passageways when rotationally aligning the parts for receiving a continuous flow line therein.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, and steps of the process, will be readily apparent to those skilled in the art and which are encompassed within the spirit of the invention and the scope of the appended claims.

What is claimed is:

1. A well tool comprising, a body including a plurality of sections which are joined together without welds or threads, said sections forming a telescoping interconnection with adjacent sections, each interconnection including a male and a female part each of which includes an outer end, sealing means positioned between each male and female part, a longitudinal extending eccentrically positioned passageway through each of the sections, said passageways being aligned for providing a fluid line through the body, a hole drilled through the female part and into the male part between the ends, and a removable plug positioned in the hole for providing for the transfer of rotational and longitudinal forces in either direction through the interconnections.

2. The apparatus of claim 1 wherein one of the sections has telescoping interconnections at each end.

3. The apparatus of claim 1 including, a continuous fluid line extending through the aligned passageways.

4. The method of making a well tool having a body consisting of a plurality of sections by interconnections without using welds or threads to join the sections together comprising, said interconnections including a male and a female part each of which includes an outer end and telescopically joining adjacent parts together with sealing means between each joined part, rotationally aligning said parts, each section includes a longitudinally extending eccentrically positioned passageway therethrough and including the step of, aligning said passageways when rotationally aligning said parts for providing a fluid line through the body, drilling a hole through the telescoping joined parts through the female part and into the male part between the ends, and placing a removable plug into the hole for providing for the transfer of rotational and longitudinal forces in either direction through the interconnections.

5. The method of claim 4 wherein the sealing means are metal face seals and including, longitudinally pressing the sections together for energizing the seal means before drilling the holes.

6. The method of claim 4 including, extending a continuous fluid line through the aligned passageways.

* * * * *